US011668255B2

(12) United States Patent
Nair et al.

(10) Patent No.: US 11,668,255 B2
(45) Date of Patent: Jun. 6, 2023

(54) ENGINE BRAKING METHOD AND CONTROL SYSTEM VARYING ENGINE BRAKING POWER WITHIN CYLINDER-NUMBER BRAKING MODE

(71) Applicant: Caterpillar Inc., Peoria, IL (US)

(72) Inventors: Rajesh Narayanan Nair, Rossville, IL (US); Samuel Were, Peoria, IL (US); James Harris Mutti, Germantown Hills, IL (US); Behnaz Ensan, Peoria, IL (US); James Vernon Dornberger, II, Canton, IL (US); Rodney L. Menold, Hanna City, IL (US); Timothy David Schwartz, East Peoria, IL (US); Kevin Walsh, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 27 days.

(21) Appl. No.: 17/116,000

(22) Filed: Dec. 9, 2020

(65) Prior Publication Data

US 2022/0178315 A1 Jun. 9, 2022

(51) Int. Cl.
*F02D 13/04* (2006.01)
*F02D 13/02* (2006.01)
(Continued)

(52) U.S. Cl.
CPC ..... *F02D 13/04* (2013.01); *F01L 13/065* (2013.01); *F02B 37/24* (2013.01);
(Continued)

(58) Field of Classification Search
CPC .. F02D 13/04; F02D 13/0249; F02D 41/2422; F02D 2200/0406; F02D 2200/101; F02B 37/24; F02B 2037/122
See application file for complete search history.

(56) References Cited

U.S. PATENT DOCUMENTS 5,540,201 A 7/1996 Feucht et al.
6,148,793 A 11/2000 Faletti et al.
(Continued)

FOREIGN PATENT DOCUMENTS

WO 9639573 W 12/1996
WO 2004059131 W 7/2004

OTHER PUBLICATIONS

International Search Report for Int'l. Patent Appln. No. GB2117445.3, dated May 3, 2022 (3 pgs).

*Primary Examiner* — Carl C Staubach

(74) *Attorney, Agent, or Firm* — Brannon Sowers & Cracraft PC

(57) ABSTRACT

An engine braking system includes engine braking actuators for adjusting exhaust valve timings to engine braking timings in a cylinder-number braking mode. The system further includes an engine braking controller coupled to a control switch that produces a request indicating a requested cylinder-number braking mode. The engine braking controller is structured to transition exhaust valves to the engine braking timings, determine a control term to adjust intake air pressure for varying a braking power of the engine, and to adjust geometry of an exhaust turbine based on the control term. An adjusted speed of a compressor rotated by the exhaust turbine provides a change to intake air pressure that adjusts the braking power of the engine. Different levels of braking power are provided within different cylinder-number braking modes.

20 Claims, 3 Drawing Sheets

(51) Int. Cl.

| | |
|---|---|
| ***F02D 41/24*** | (2006.01) |
| ***F02B 37/24*** | (2006.01) |
| ***F01L 13/06*** | (2006.01) |
| *F02B 37/12* | (2006.01) |

(52) U.S. Cl.
CPC ..... *F02D 13/0249* (2013.01); *F02D 41/2422* (2013.01); *F02B 2037/122* (2013.01); *F02D 2200/0406* (2013.01); *F02D 2200/101* (2013.01)

(56) References Cited

U.S. PATENT DOCUMENTS

| | | | | |
|---|---|---|---|---|
| 6,609,495 | B1 | 8/2003 | Cornell et al. | |
| 6,883,318 | B2 * | 4/2005 | Warner | F02D 13/04 123/321 |
| 7,347,048 | B2 | 3/2008 | Albat | |
| 8,151,567 | B2 * | 4/2012 | Rollinger | F02D 41/0007 60/602 |
| 8,290,689 | B2 * | 10/2012 | Andrasko | F02D 9/06 123/320 |
| 9,546,592 | B2 | 1/2017 | Lingens et al. | |
| 10,982,605 | B2 * | 4/2021 | Were | F02D 41/0007 |
| 2002/0174654 | A1 | 11/2002 | Yang | |
| 2011/0011081 | A1 * | 1/2011 | Quigley | F02D 41/0007 60/297 |
| 2014/0214308 | A1 * | 7/2014 | Mulloy | F02D 13/04 701/110 |
| 2019/0040802 | A1 | 2/2019 | Lilly | |
| 2022/0056854 | A1 * | 2/2022 | Robel | F02D 41/0007 |

* cited by examiner

ENGINE BRAKING METHOD AND CONTROL SYSTEM VARYING ENGINE BRAKING POWER WITHIN CYLINDER-NUMBER BRAKING MODE

TECHNICAL FIELD

The present disclosure relates generally to engine braking, and more particularly to varying engine braking power by way of intake air pressure control within a cylinder-number braking mode.

BACKGROUND

Engine compression release braking is generally understood as a practice that operates combustion cylinders in an engine to compress air without combusting fuel, effectively transforming the engine into an air compressor to retard engine speed. While a great many different hardware designs and control strategies have been proposed over the years, the basic concept of compression release braking requires modifying engine valve timings from a normal timing used in combustion cycles to an engine braking timing.

In one typical strategy, an exhaust valve is held closed during a portion of a piston's compression stroke in a combustion cylinder, and then opened just before the subject piston reaches top-dead-center instead of remaining closed as would occur during an engine cycle. No fuel is injected during the engine cycle so no combustion take place to produce a power stroke. The compressed air in the cylinder is discharged to the exhaust system, thus retarding engine speed based on the work required to compress the air. Various modifications to the opening timing, closing timing, number of opening and closing events within an engine cycle, and still other parameters have been the subject of much experimentation in the engine field.

A desire for flexibility in the relative amount or power of engine braking has led to strategies where all of the combustion cylinders in an engine are operated in a braking mode, or only some of the combustion cylinders are operated in a braking mode. While such strategies can provide greater flexibility than an all or nothing approach, there remains ample room for improvements and/or alternative strategies. U.S. Pat. No. 6,609,495 to Cornell et al. sets forth one example strategy for electronic control of an engine braking cycle.

SUMMARY OF THE INVENTION

In one aspect, a method of braking an engine includes operating an engine in a cylinder-number braking mode where exhaust valves for at least some combustion cylinders in the engine are operated in an engine braking timing pattern, and determining a control term indicative of at least one of an intake air pressure or a change to an intake air pressure that varies a braking power of the engine. The method further includes commanding varying a position of an exhaust-impinged surface in an exhaust turbine for the engine based on the determined control term, and varying a speed of an intake air compressor for the engine driven by the exhaust turbine, based on the commanded varying of a position of the exhaust-impinged surface. The method still further includes adjusting the braking power of the engine, within the cylinder-number braking mode, based on a change to intake air pressure in the engine occurring in response to the varied speed of the intake air compressor.

In another aspect, an engine braking control system includes an engine braking controller structured to couple to an engine braking control switch. The engine braking controller is further structured to receive an engine braking request from the engine braking control switch indicative of a requested cylinder-number braking mode in an engine having a plurality of combustion cylinders, and to command operation of exhaust valves for a number of the combustion cylinders that is dependent upon the requested cylinder-number braking mode in an engine braking timing pattern. The engine braking controller is still further structured to determine a control term that is indicative of at least one of an intake air pressure or a change to an intake air pressure that varies a braking power of the engine within the requested cylinder-number braking mode, and to command varying a position of an exhaust-impinged surface in an exhaust turbine coupled to the engine, based on the determined control term, to vary a speed of a compressor driven by the exhaust turbine. The engine braking controller is still further structured to adjust the braking power of the engine based on a change to a pressure of intake air supplied to the engine in response to the varied speed of the compressor.

In still another aspect, an engine braking system includes a plurality of engine braking actuators structured to adjust timings of exhaust valves for a plurality of combustion cylinders in an engine. The engine braking system further includes an exhaust turbine actuator structured to couple with an exhaust-impinged surface in an exhaust turbine, and an engine braking control system. The engine braking control system includes an engine braking control switch, an engine speed sensor, and an engine braking controller coupled to the engine braking control switch and to the engine speed sensor. The engine braking controller is structured to command, using the respective engine braking actuators, transitioning at least some of the exhaust valves from a first timing pattern to an engine braking timing pattern, based on an engine braking request from the engine braking control switch indicative of a requested cylinder-number braking mode of the engine. The engine braking controller is further structured to determine, based on an engine speed signal produced by the engine speed sensor, a control term that is indicative of at least one of an intake air pressure or a change to an intake air pressure that varies a braking power of the engine within the requested cylinder-number braking mode. The engine braking controller is still further structured to command, using the exhaust turbine actuator, varying a position of an exhaust-impinged surface in the exhaust turbine based on the determined control term, such that a speed of a compressor rotated by the exhaust turbine is varied. The engine braking controller is still further structured to adjust the braking power of the engine based on a change to intake air pressure occurring in response to the commanded varying of a position of the exhaust-impinged surface.

DETAILED DESCRIPTION

Figure 1:
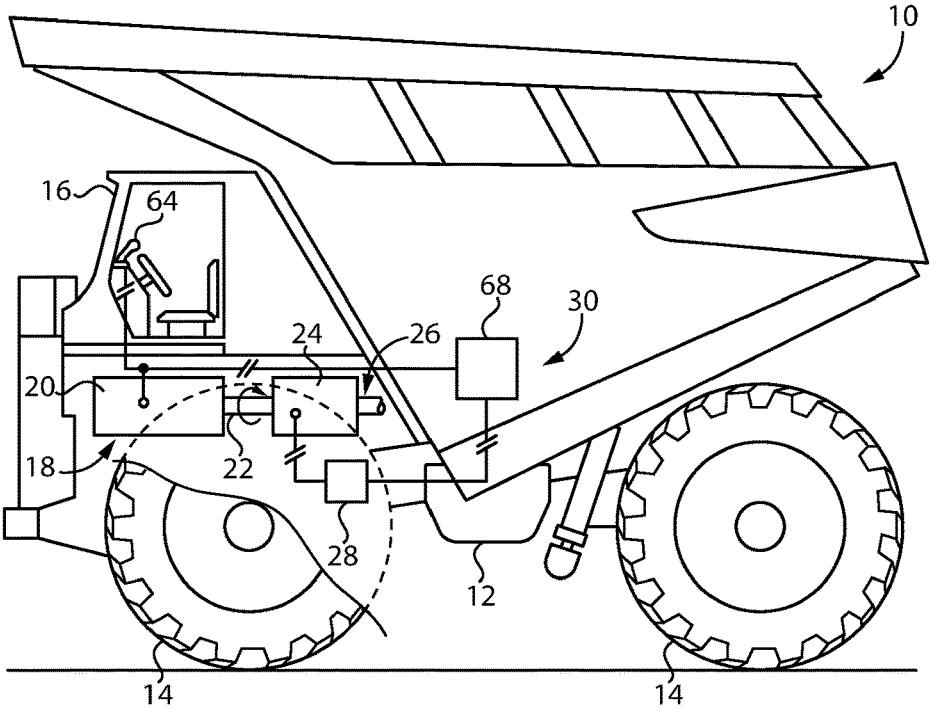
FIG. 1 is a side diagrammatic view of a machine, according to one embodiment.

Referring to FIG. 1, there is shown a machine 10 according to one embodiment, and including a frame 12, and ground-engaging wheels 14 supporting frame 12. Machine 10 is shown in the context of a non-articulated truck, however, it should be appreciated that machine 10 could be a variety of off-highway machines such as an articulated truck, a scraper, a wheel loader, a backhoe, a tractor, or an on-highway machine to name a few examples. Machine 10 also includes an operator cab 16 supported by frame 12, and an internal combustion engine system 18 for providing propulsive power to machine 10 and running various systems thereon. Internal combustion engine system 18 includes an engine 20 and a rotatable output shaft driven by engine 20. Output shaft 22 is in turn coupled to a transmission 24 that rotates a driveline 26 which will be understood to extend to at least a front set or a back set, and typically both a front set and a back set, of ground-engaging wheels 14.

Figure 2:
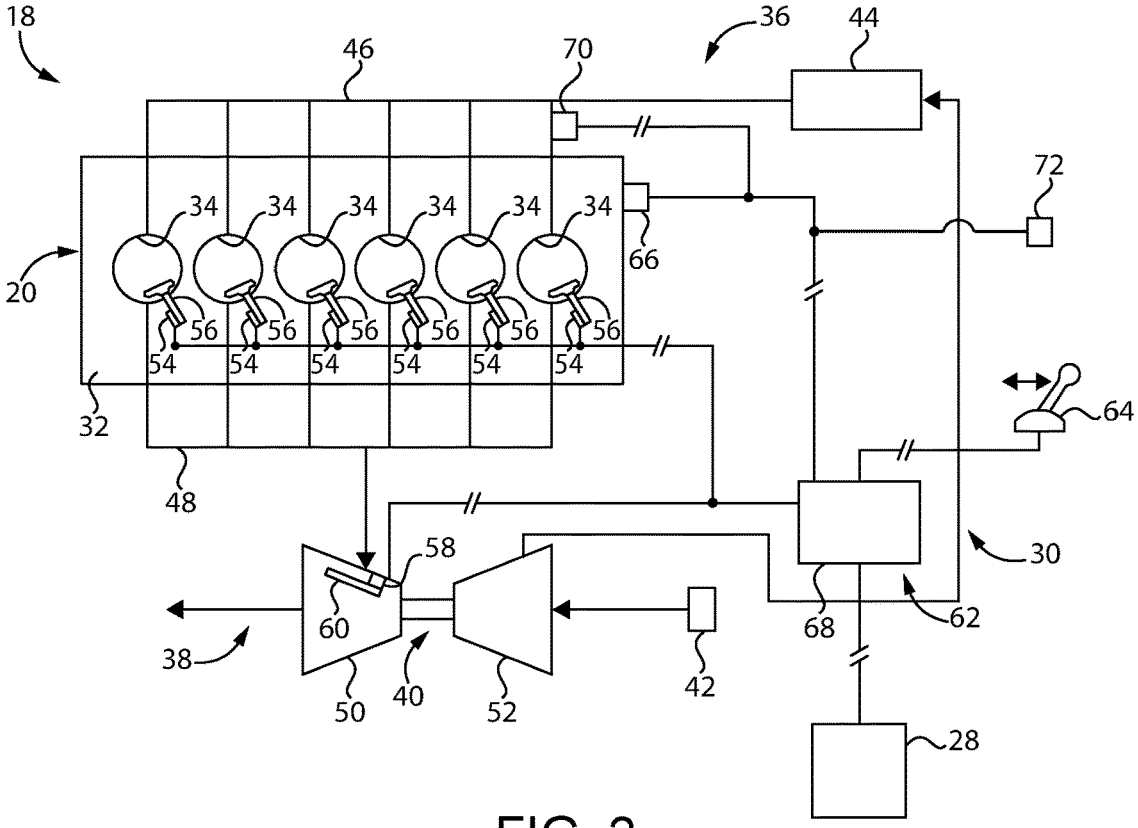
FIG. 2 is a diagrammatic view of an internal combustion engine system, according to one embodiment.

Referring also now to FIG. 2, there are shown further features of internal combustion engine system 18, including a cylinder block 32 of engine 20 having a plurality of combustion cylinders 34 formed therein. In the illustrated embodiment, combustion cylinders 34 are six in number and arranged in an inline configuration. Engine 20 could include any number of combustion cylinders in any suitable arrangement. Internal combustion engine system 18 further includes an intake system 36 structured to deliver intake air, or potentially intake air and other gases such as recirculated exhaust gas and/or fumigated gaseous fuel, to combustion cylinders 34. Intake system 36 has an air inlet 42 and an aftercooler 44 that feeds intake air to an intake manifold 46 fluidly connected to combustion cylinders 34. Internal combustion engine system 18 also includes an exhaust system 38 structured to receive exhaust from an exhaust manifold 48 and typically convey the exhaust to a tailpipe or an exhaust stack by way of an aftertreatment system (not shown). Internal combustion engine system 18 also includes a turbocharger 40 having an exhaust turbine 50 positioned within exhaust system 38, and an intake air compressor 52 rotated by way of exhaust turbine 50 and positioned within intake system 36.

Internal combustion engine system 18 further includes an engine braking system 30. Engine braking system 30 includes a plurality of engine braking actuators 54 structured to adjust timings or timing patterns of a plurality of exhaust valves 56 for combustion cylinders 34 in engine 20. Engine braking actuators 54 could be electronically controlled hydraulic actuators, pneumatic actuators, or electrical actuators, that controllable open, controllably close, hold open, hold closed, or otherwise control the positions of exhaust valves 56 at desired engine timings. Each combustion cylinder 34 is shown associated with one exhaust valve 54, however, it will be appreciated that each combustion cylinder 34 may be associated with multiple exhaust valves as well as multiple intake valves (not shown) in a practical implementation. Engine braking actuators 54 may control the state of one or plural exhaust valves.

Engine braking system 30 further includes an exhaust turbine actuator 58 structured to couple with an exhaust-impinged surface 60 in exhaust turbine 50. Exhaust turbine actuator 58, or multiple exhaust turbine actuators if used, may be electronically controlled hydraulic actuators, pneumatic actuators, or electrical actuators. Exhaust-impinged surface 60 can include a surface of a turbine vane, approximately as shown, having a position that can be varied relative to a flow of exhaust through exhaust turbine 50 to vary an internal geometry of exhaust turbine 50. In other embodiments, exhaust-impinged surface 60 could include a movable turbine wall surface, or still another movable surface, having a position relative to the flow of exhaust that varies a speed of rotation of exhaust turbine 50 in a generally known manner. A change to an orientation of an exhaust-impinged surface relative to a flow of exhaust is a change to a position as contemplated herein. As noted above, intake air compressor 52 is rotated by exhaust turbine 50, and thus has a compressor speed that can be varied by varying a position of exhaust-impinged surface 60 for purposes that will be apparent from the following description.

Engine braking system 30 further includes an engine braking control system 62 including an engine braking control switch 64, an engine speed sensor 66, and an engine braking controller 68 coupled to engine braking control switch 64 and to engine speed sensor 66. In one practical implementation, engine braking control switch 64 may be positioned in cab 16 of machine 10 for manipulation by an operator. Also in a practical implementation, engine braking control switch 64 can have a plurality of different positions, finite in number, each corresponding to a requested cylinder-number braking mode of engine 20. Engine braking controller 68 can include any suitable electronic control unit, such as a microprocessor, or a microcontroller, having a central processing unit in communication with a computer readable memory structured to store program instructions for operating engine braking system 30 as further discussed herein.

Engine braking controller 68 may be structured to receive an engine braking request from engine braking control switch 64 indicative of a requested cylinder-number braking mode in engine 20. Engine braking controller 68 may be further structured to command, using respective engine braking actuators 54, transitioning at least some of exhaust valves 56 from a first timing pattern to an engine braking timing pattern, based on the engine braking request from engine braking control switch 64 indicative of a requested cylinder-number braking mode of engine 20. A cylinder-number braking mode means operation, for a given number of combustion cylinders, where at least some of exhaust valves 56 associated with the respective combustion cylinders open and/or close at appropriate timings for compression release braking. A first cylinder-number braking mode could include operating two of combustion cylinders 34 and associated exhaust valves 56 in an engine braking timing pattern to brake engine 20, while permitting four of combustion cylinders 34 and associated exhaust valves 56 to continue operating according to a normal timing pattern or a combustion timing pattern, but without combusting any fuel. A second cylinder-number braking mode could include operating four of combustion cylinders 34 and associated exhaust valves 56 to brake engine 20, whereas a third cylinder-number braking mode can include operating all of combustion cylinders 34 and associated exhaust valves 56 at engine braking timings to brake engine 20. Also in a practical implementation, engine 20 is a compression-ignition engine operated on a directly injected liquid fuel such as a diesel distillate fuel. In other embodiments, however, engine 20 could be operated on a different fuel type or otherwise according to hardware and operating methodology different from that explicitly disclosed herein.

Engine braking controller 68 may be further structured to determine, based on an engine speed signal produced by engine speed sensor 66, a control term that is indicative of at least one of an intake air pressure or a change to an intake air pressure that varies a braking power of engine 20 within the requested cylinder-number braking mode. The control term can include a numerical term, for example, that is or corresponds to an absolute intake air pressure that is desired or a change to an absolute intake air pressure that is desired, to vary braking power without changing a number of combustion cylinders and associated exhaust valves 56 presently operated to brake engine 20. In a practical implementation, the subject control term includes a desired intake manifold air pressure (IMAP). Engine braking system 30 and engine braking control system 62 may further include an IMAP sensor 70 structured to monitor an IMAP for purposes further discussed herein. Engine braking system 30 and engine braking control system 62 may also include an altitude sensor 72, structured to produce an altitude signal 72 also used by engine braking controller 68 in determining the subject control term. Any of engine speed, intake air pressure, or altitude, can be determined directly or indirectly by any suitable sensor or sensor group or even a so-called virtual sensor in some embodiments. Thus, an altitude sensor might not necessarily sense altitude directly, and an altitude signal might not explicitly encode altitude but instead a value indirectly indicative of or having a known or determinable relationship with altitude.

Also depicted in FIG. 2 is a second controller 28 structured to produce a braking power modulation request, with engine braking controller 68 being further structured to determine the subject control term responsive to a braking power modulation request produced by second controller 28. Second controller 28 can include a transmission controller for transmission 24 in some embodiments. It is contemplated that by monitoring a speed of a rotatable element in transmission 24, or by monitoring a change to a speed of a rotatable element, or relative speeds between two rotatable elements, transmission controller 28 can operate to request modulation of engine braking power up or down if a desired engine braking power level is not presently obtained within a present cylinder-number engine braking mode. Transitioning to an increased engine braking power, a decreased engine braking power, or maintaining an engine braking power, may be performed to assist in adjusting or maintaining a speed of machine 10, for example, or for other purposes such as to prevent a transmission overspeed condition. Where machine 10 encounters a steeper downhill grade, for instance, engine braking power might need to be increased to keep machine 10 from speeding up. Where machine 10 encounters a downhill grade that is less steep, engine braking power might need to be decreased to avoid unduly slowing down. In all cases, it is contemplated that engine braking system 30 can substantially reduce any need to use a service brake of machine 10.

It will be recalled that engine braking control switch 64 can be moved by an operator to vary a requested cylinder-number braking mode, such as by moving switch 64 between a finite number of switch configurations, for example, lever positions, each corresponding to one of a plurality of available cylinder-number braking modes. Accordingly, certain aspects of the present disclosure can be thought of as providing an operator with control to select a number of cylinders that will be used to brake engine 20, with second controller 28 operating to cause modulation of the actual braking power output in a manner responsive to present conditions. Various other justifications than transmission speeds or relative speeds, for example, a machine ground speed or acceleration, could serve as the basis for a braking power modulation request.

Engine braking controller 68 is further structured to command, using exhaust turbine actuator 58, varying a position of exhaust-impinged surface 60 in exhaust turbine 50 based on the determined control term, such that a speed of intake air compressor 52 rotated by exhaust turbine 50 is varied. Thus, engine braking controller 68 can be thought of as adjusting a position of exhaust-impinged surface 60 that can increase or decrease a speed of rotation of compressor 52. Engine braking controller 68 is thus further structured to adjust a braking power of engine 20 based on a change to intake air pressure occurring in response to the commanded varying of position of exhaust-impinged surface 60. In this aspect, engine braking controller 68 is thus understood to increase or decrease compressor speed to increase or decrease braking power as the resulting change to intake air pressure varies the amount of work performed by combustion cylinders currently operating to brake engine 20.

It will be recalled the intake air pressure or change to intake air pressure of interest may be IMAP. Embodiments are contemplated where the sole variable targeted for adjusting braking power within a given cylinder-number braking mode is IMAP. It will also be recalled engine braking control system 62 may include IMAP sensor 70. IMAP sensor 70 is structured to monitor IMAP, and engine braking controller 68 may be further structured to command a further change to a position of exhaust-impinged surface 60 based on monitored IMAP. In this way, engine braking controller 68 may periodically or continually adjust exhaust-impinged surface 60, such as by adjusting a position or orientation of a turbine vane, to drive IMAP towards a desired IMAP.

Figure 3:
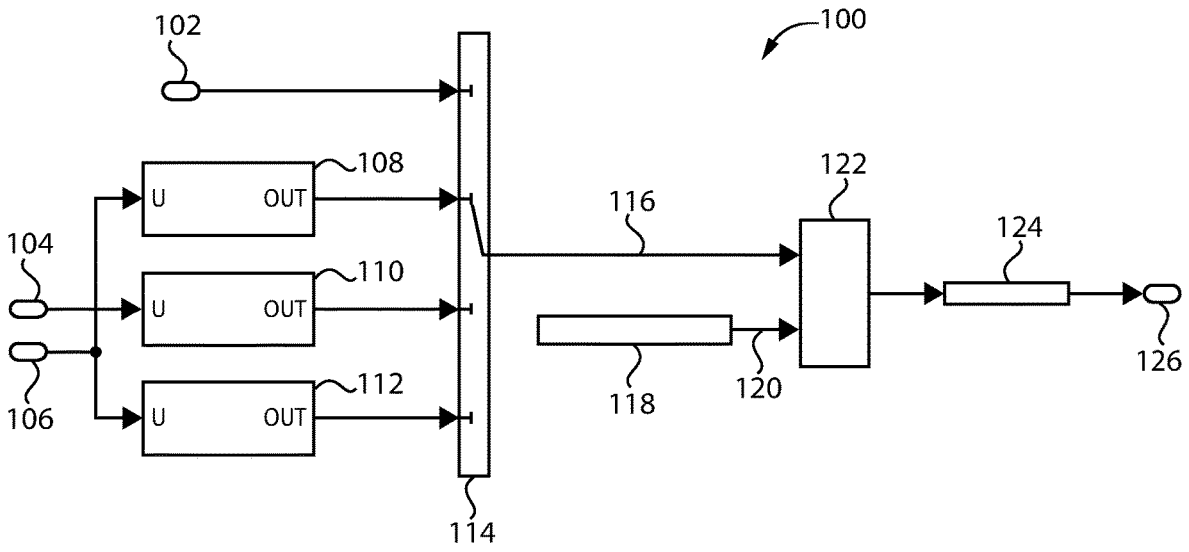
FIG. 3 is a control diagram of engine braking control aspects, according to one embodiment.

Referring also now to FIG. 3, there is shown a control diagram 100 illustrating example operations that can be performed by engine braking controller 68, in part by engine braking controller 68 and another controller, or by a different controller entirely. In FIG. 3 an engine braking request 102 is shown that requests a cylinder-number braking mode from among a plurality of available cylinder-number braking modes each braking engine 20 using a different number of combustion cylinders. Also shown in FIG. 3 is an engine speed signal at 104 and an altitude signal at 106. Control diagram 100 also shows an indexed switch 114 that receives map values determined from a plurality of maps 108, 110, 112, each used for braking power modulation in a different one of a plurality of available cylinder-number braking modes. Map 108 may include a map for use when engine 20 is operated at a high-power cylinder-number braking mode, such as where all cylinders are used to brake engine 20. Map 110 may be used when engine 20 is operated at a medium-power cylinder-number braking mode where not all combustion cylinders are used in braking engine 20, and map 112 may be used when engine 20 is operated at a low-power cylinder-number braking mode where a still lesser number of combustion cylinders are used in braking engine 20. Each of maps 108, 110, 112 may have as coordinates engine speed and altitude. Maps 108, 110, 112 may also be calibrated in consideration of other factors such as performance factors and hardware limitations, for example. Indexed switch 114 enables engine braking controller 68, or another suitable controller, to determine a control term 116 from the appropriate one of maps 108, 110, 112 corresponding to the present cylinder-number braking mode, engine speed, and altitude. Control term 116 can include a raw control term, such as a raw desired IMAP, that is processed according to a filtering determination or calculation at 122. A filter 118, such as a low-pass filter, provides a filter term 120 or a gain term that is used in block 122 to produce a filtered desired IMAP control term 124. Desired IMAP is output at 126 for use in commanding adjustment of exhaust-impinged surface 60. Those skilled in the art will appreciate that exhaust turbine actuator 58 translates or rotates exhaust-impinged surface 60 in a manner expected to vary internal geometry of exhaust turbine 50, and therefore vary an amount of exhaust energy transformed into rotational mechanical energy of intake air compressor 52.

Figure 4:
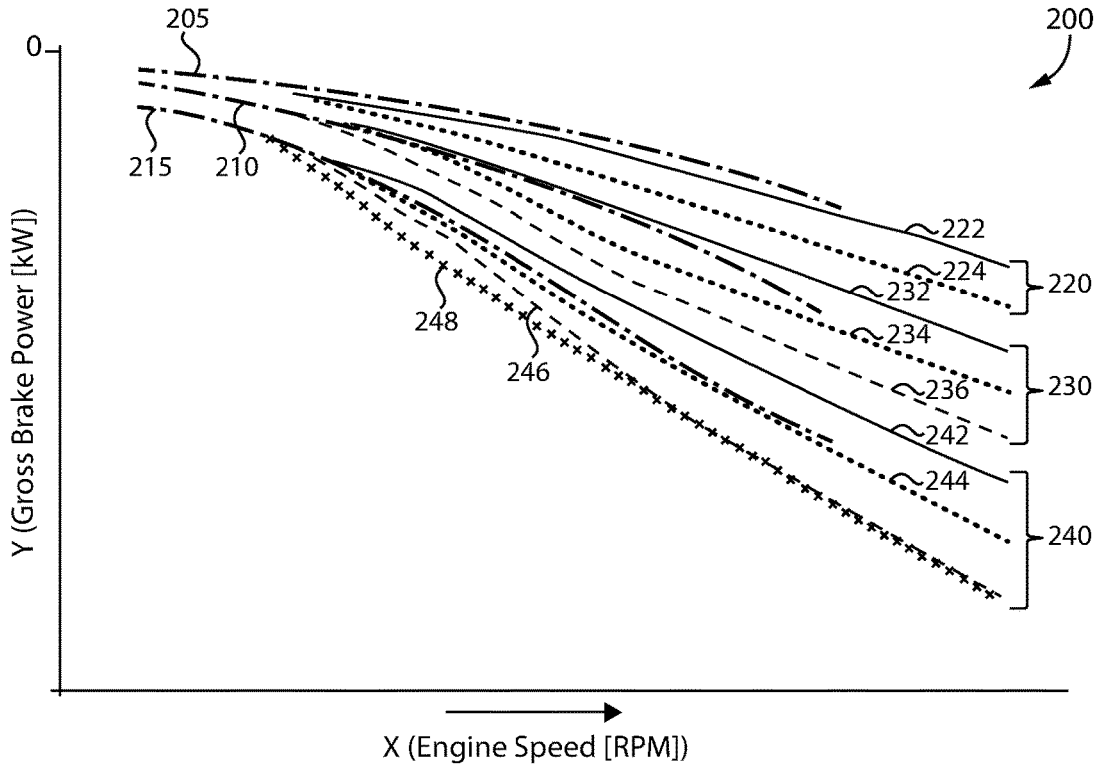
FIG. 4 is a graph showing engine braking power in an engine controlled according to the present disclosure, in comparison to a known design.

Referring also now to FIG. 4, there is shown a graph 200 with engine speed in revolutions per minute (RPM) on the X-axis and gross brake power in kilowatts on the Y-axis. A curve 205 illustrates a lower braking power in an engine system using a fixed geometry turbine where a lesser number of combustion cylinders are operated to brake the engine. A curve 210 illustrates a medium braking power in an engine having a fixed geometry turbine where a greater number of combustion cylinders are used to brake the engine, and a curve 215 illustrates a higher engine braking power mode in an engine having a fixed geometry turbine where all of the combustion cylinders are used to brake the engine.

It will be recalled that braking level can be modulated within a present cylinder-number braking mode according to the present disclosure. Reference numeral 220 shows a lower braking power level at a curve 222, and a higher braking power level at a curve 224 that can be obtained according to the present disclosure where IMAP is varied within a lower-power cylinder-number braking mode, in other words a lesser number of combustion cylinders operated to brake the engine. Reference numeral 220 identifies a range of braking power that can be obtained for the lower-level cylinder number braking mode. Another range 230 including curves 232, 234, and 236 is shown illustrating braking power levels that can be obtained in a medium-power cylinder-number braking mode, in other words a mode where a greater number of combustion cylinders but less than all combustion cylinders, are used to brake the engine. Yet another range is shown at 240 for a higher power cylinder-number braking mode such as might be used where all combustion cylinders are operated to brake the engine, and includes curves 242, 244, 246, and 248 corresponding to the different braking power levels.

In view of FIG. 4 it will be understood that rather than only three braking power levels each determined based solely on a number of combustion cylinders used for engine braking, according to the present disclosure multiple different power levels can be obtained for each cylinder-number braking mode. While in the illustrated case nine power levels are seen amongst ranges 220, 230, and 240, a different number of power levels and continuous transition between power levels can be obtained. Moreover, while the illustrated case contemplates braking an engine with two, four, or all six combustion cylinders in a six cylinder engine, it will be appreciated that other embodiments could have a greater number or a lesser number of cylinder-number braking modes.

INDUSTRIAL APPLICABILITY

Figure 5:
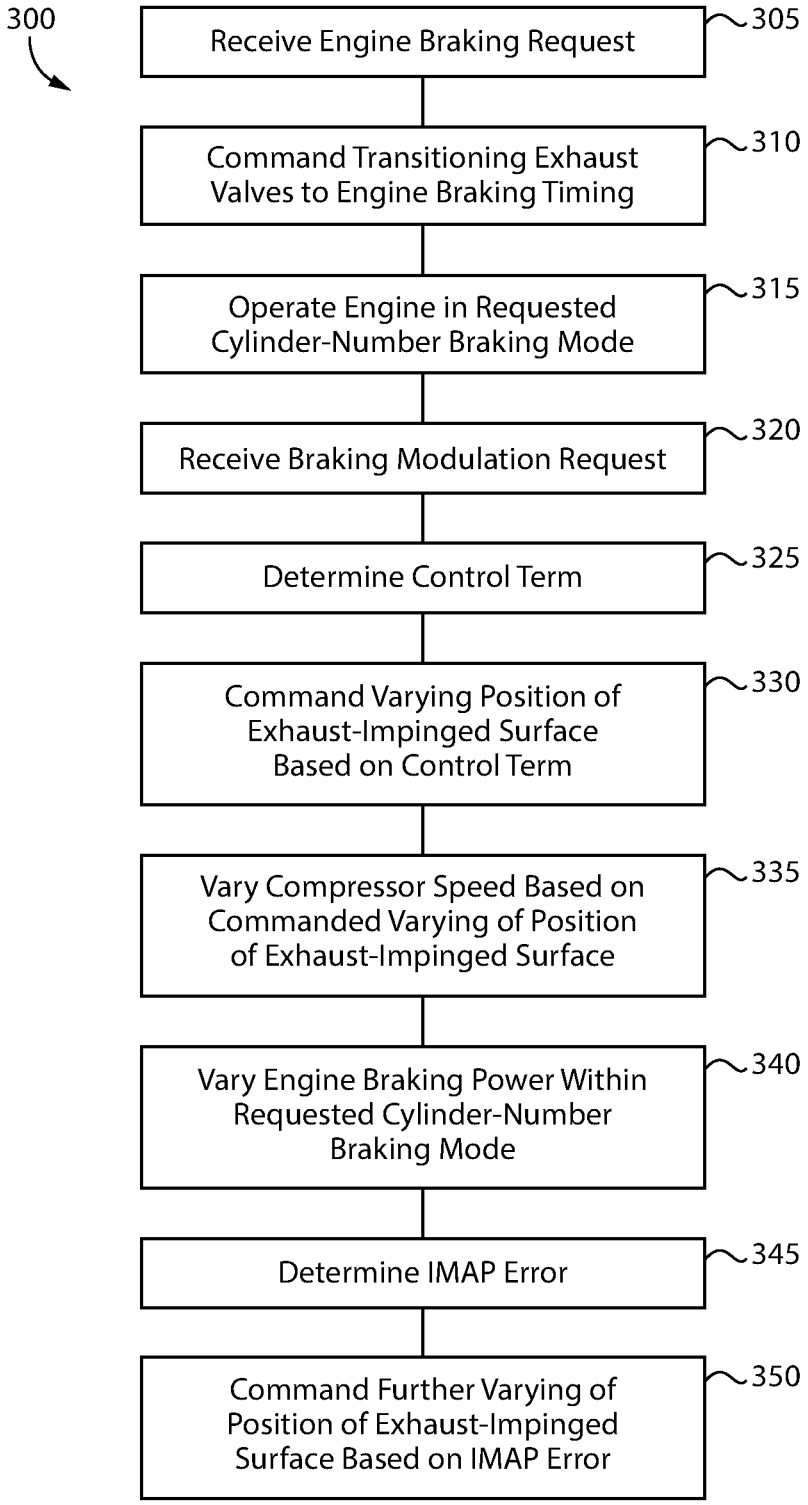
FIG. 5 is a flowchart illustrating example methodology and control logic flow, according to one embodiment.

Referring to the drawings generally, but also now to FIG. 5, there is shown a flowchart 300 illustrating example methodology and control logic flow that might be used in braking an engine according to the present disclosure. Flowchart 300 includes a block 305 where an engine braking request is received, as described herein requesting a cylinder-number braking mode from among a plurality of available cylinder-number braking modes each braking an engine using a different number of combustion cylinders. From block 305, flowchart 300 advances to a block 310 to command transitioning at least some exhaust valves in an engine from a first timing pattern to an engine braking timing pattern, such that operation of the exhaust valves for a number of the combustion cylinders is commanded that is dependent upon the requested cylinder-number braking mode. The engine braking request might indicate engine braking using two cylinders, engine braking using four cylinders, engine braking using all six cylinders in a six-cylinder engine, or some other cylinder-number braking mode. From block 310, flowchart 300 advances to a block 315 to operate the engine in the requested cylinder-number braking mode.

From block 315, flowchart 300 advances to a block 320 to receive a braking modulation request as discussed herein that is a request to vary engine braking power within a present cylinder-number braking mode, in other words, varied braking power level without changing a number of combustion cylinders used in engine braking. From block 320, flowchart 300 advances to a block 325 to determine a control term, such as a desired IMAP, as discussed herein. From block 325, flowchart 300 advances to a block 330 to command varying a position of an exhaust-impinged surface based on the determined control term. From block 330, flowchart 300 advances to a block 335 to vary compressor speed based on the commanded varying of position of the exhaust-impinged surface. From block 335, flowchart 300 advances to a block 340 to vary engine braking power within the requested cylinder-number braking mode. It will also be recalled that engine braking control, according to the present disclosure, can include closed loop control of a target intake air pressure variable such as desired IMAP. From block 340, flowchart 300 advances to a block 345 to determine IMAP error, such as by comparing monitored IMAP to desired IMAP, and thenceforth to a block 350 to command further varying of a position of exhaust-impinged surface based on the determined IMAP error.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of braking an engine comprising:

operating an engine in a cylinder-number braking mode where exhaust valves for some combustion cylinders in the engine are operated in an engine braking timing pattern and exhaust valves for some combustion cylinders in the engine are operated in a combustion timing pattern;

determining a control term indicative of at least one of an intake air pressure different from a present intake air pressure or a change to an intake air pressure from a present intake air pressure, that varies a braking power of the engine;

commanding varying a position of an exhaust-impinged surface in an exhaust turbine for the engine based on the determined control term;

varying a speed of an intake air compressor for the engine driven by the exhaust turbine, based on the commanded varying of a position of the exhaust-impinged surface; and decreasing the braking power of the engine, within the cylinder-number braking mode, based on a decrease to intake air pressure in the engine occurring in response to the varied speed of the intake air compressor; and the decreasing the braking power including decreasing the braking power via closed loop control using intake air pressure as a targeted variable.

2. The method of claim 1 further comprising:

receiving an engine braking request requesting the cylinder-number braking mode from among a plurality of available cylinder-number braking modes each braking the engine using a different number of combustion cylinders; and commanding the operation of exhaust valves in the engine braking timing pattern, for a number of the combustion cylinders that is dependent upon the cylinder-number braking mode requested.

3. The method of claim 2 wherein the receiving of the engine braking request includes receiving an engine braking request from an engine braking control switch in a cab of a machine having a driveline coupled to the engine.

4. The method of claim 2 wherein the determining of a control term includes determining the control term using a map associated with the requested cylinder-number braking mode.

5. The method of claim 4 wherein the map is one of a plurality of maps each corresponding to one of the plurality of available cylinder-number braking modes.

6. The method of claim 1 further comprising receiving an engine speed signal and receiving an altitude signal, and the determining of the control term includes determining the control term based on the engine speed signal and the altitude signal.

7. The method of claim 1 wherein the determining of the control term includes determining a desired intake manifold pressure (IMAP).

8. The method of claim 7 further comprising monitoring an IMAP, determining an IMAP error based on a difference between the monitored IMAP and the desired IMAP, and commanding further varying of the position of the exhaust-impinged surface in the exhaust turbine based on the IMAP error.

9. The method of claim 1 wherein the commanding varying of a position of an exhaust-impinged surface includes commanding varying a turbine vane position in the exhaust turbine.

10. The method of claim 9 further comprising receiving a braking power modulation request, and the determining of the control term is based on the braking power modulation request.

11. An engine braking control system comprising:

an engine braking controller structured to couple to an engine braking control switch, and further structured to:

receive an engine braking request from the engine braking control switch indicative of a requested cylinder-number braking mode in an engine having a plurality of combustion cylinders;

command operation of exhaust valves for a number of the combustion cylinders that is dependent upon the requested cylinder-number braking mode in an engine braking timing pattern;

determine a control term that is indicative of at least one of an intake air pressure different from a present intake air pressure or a change to an intake air pressure from a present intake air pressure that varies a braking power of the engine within the requested cylinder-number braking mode;

command varying a position of an exhaust-impinged surface in an exhaust turbine coupled to the engine, based on the determined control term, to vary a speed of a compressor driven by the exhaust turbine;

decrease the braking power of the engine based on a decrease to a pressure of intake air supplied to the engine in response to the varied speed of the compressor; and control the decreasing of the braking power of the engine via closed loop control using intake air pressure as a targeted variable.

12. The engine braking control system of claim 11 further comprising an engine speed sensor, and the engine braking controller is further structured to determine the control term based on an engine speed signal produced by the engine speed sensor.

13. The engine braking control system of claim 12 wherein the engine braking controller is further structured to determine the control term using a map having as coordinates engine speed and altitude.

14. The engine braking control system of claim 13 wherein the map is one of a plurality of stored maps each associated with a different cylinder-number braking mode of the engine.

15. The engine braking control system of claim 11 wherein the control term includes a desired intake manifold air pressure (IMAP).

16. The engine braking control system of claim 15 further comprising an IMAP sensor structured to produce an IMAP signal, and the engine braking controller is further structured to determine an IMAP error based on the IMAP signal and the desired IMAP, and to command further varying of the position of the exhaust-impinged surface in the exhaust turbine based on the IMAP error.

17. The engine braking control system of claim 11 further comprising:

the engine braking control switch, and the engine braking control switch having a finite number of switch configurations each corresponding to one of a plurality of available cylinder-number braking modes; and a second controller structured to produce a braking power modulation request, and the engine braking controller is further structured to determine the control term based on the braking power modulation request.

18. An engine braking system comprising:

a plurality of engine braking actuators structured to adjust timings of exhaust valves for a plurality of combustion cylinders in an engine;

an exhaust turbine actuator structured to couple with an exhaust-impinged surface in an exhaust turbine;

an engine braking control system including an engine braking control switch, an engine speed sensor, and an engine braking controller coupled to the engine braking control switch and to the engine speed sensor;

the engine braking controller is structured to:

command, using the respective engine braking actuators, transitioning at least some of the exhaust valves from a first timing pattern to an engine braking timing pattern, based on an engine braking request from the engine braking control switch indicative of a requested cylinder-number braking mode of the engine;

determine, based on an engine speed signal produced by the engine speed sensor, a control term that is indicative of at least one of an intake air pressure different a present intake air pressure or a change to an intake air pressure from a present intake air pressure that varies a braking power of the engine within the requested cylinder-number braking mode;

command, using the exhaust turbine actuator, varying a position of an exhaust-impinged surface in the exhaust turbine based on the determined control term, such that a speed of a compressor rotated by the exhaust turbine is varied;

decrease the braking power of the engine based on a decrease to intake air pressure occurring in response to the commanded varying of a position of the exhaust-impinged surface; and control the decrease of the braking power of the engine via closed loop control using intake air pressure as a targeted variable.

19. The engine braking system of claim 18 further comprising an intake manifold air pressure (IMAP) sensor structured to monitor an IMAP, and the engine braking controller is further structured to command a further change to a position of the exhaust impinged surface based on the monitored IMAP.

20. The engine braking system of claim 18 further comprising a transmission controller structured to produce a braking power modulation request, and the engine braking controller is further structured to determine the control term based on the braking power modulation request.

* * * * *